US005812904A

United States Patent [19]

Rhee et al.

[11] Patent Number: 5,812,904

[45] Date of Patent: Sep. 22, 1998

[54] IMAGE FORMING APPARATUS AND METHOD FOR CONTROLLING CHARGING POTENTIAL DIFFERENTLY BETWEEN IMAGE FORMING AREA AND NON-IMAGE FORMING AREA OF PHOTOSENSITIVE DRUM

[75] Inventors: Chang-Soo Rhee; Yong-Baek Yoo, both of Suwon, Rep. of Korea

[73] Assignee: SamSung Electronics Co., Ltd., Suwon, Rep. of Korea

[21] Appl. No.: 714,759

[22] Filed: Sep. 16, 1996

[30] Foreign Application Priority Data

Sep. 19, 1995 [KR] Rep. of Korea ..... 30745

[51] Int. Cl.[6] ..... G03G 15/02

[52] U.S. Cl. ..... 399/50; 399/169

[58] Field of Search ..... 399/50, 168, 169; 361/225

[56] References Cited

U.S. PATENT DOCUMENTS

| | | | |
|---|---|---|---|
| 4,839,695 | 6/1989 | Yamamoto et al. | 399/169 |
| 5,002,266 | 3/1991 | Kikuchi et al. | 271/3 |
| 5,072,258 | 12/1991 | Harada | 399/50 |
| 5,287,149 | 2/1994 | Hoshika | 399/138 |
| 5,424,809 | 6/1995 | Sawayama et al. | 399/56 |
| 5,450,180 | 9/1995 | Ohzeki et al. | 399/50 |
| 5,534,982 | 7/1996 | Sakaizawa et al. | 399/270 |
| 5,568,232 | 10/1996 | Kashihara | 399/50 X |

*Primary Examiner*—William J. Royer
*Attorney, Agent, or Firm*—Robert E. Bushnell, Esq.

[57] ABSTRACT

A system for controlling a potential of a photosensitive drum for a laser beam printer having a photosensitive drum on which an electrostatic image is formed, a charger for applying voltages differentially to an image forming area where the photosensitive drum contacts a recording medium and to a non-image forming area where the photosensitive drum does not contact the recording medium to charge the outer surface of the photosensitive drum to a given polarity, a light scanner unit for forming an electrostatic latent image on the drum corresponding to image data, a developing unit for applying toner onto the photosensitive drum during the image forming area and a transfer charger for transferring a toner image formed on the drum to the recording medium. The system includes a potential controlling unit for applying a first charging potential to the photosensitive drum during the image forming area to charge the photosensitive drum to a given voltage for development, and for applying a second charging potential to the photosensitive drum during the non-image forming area.

15 Claims, 3 Drawing Sheets

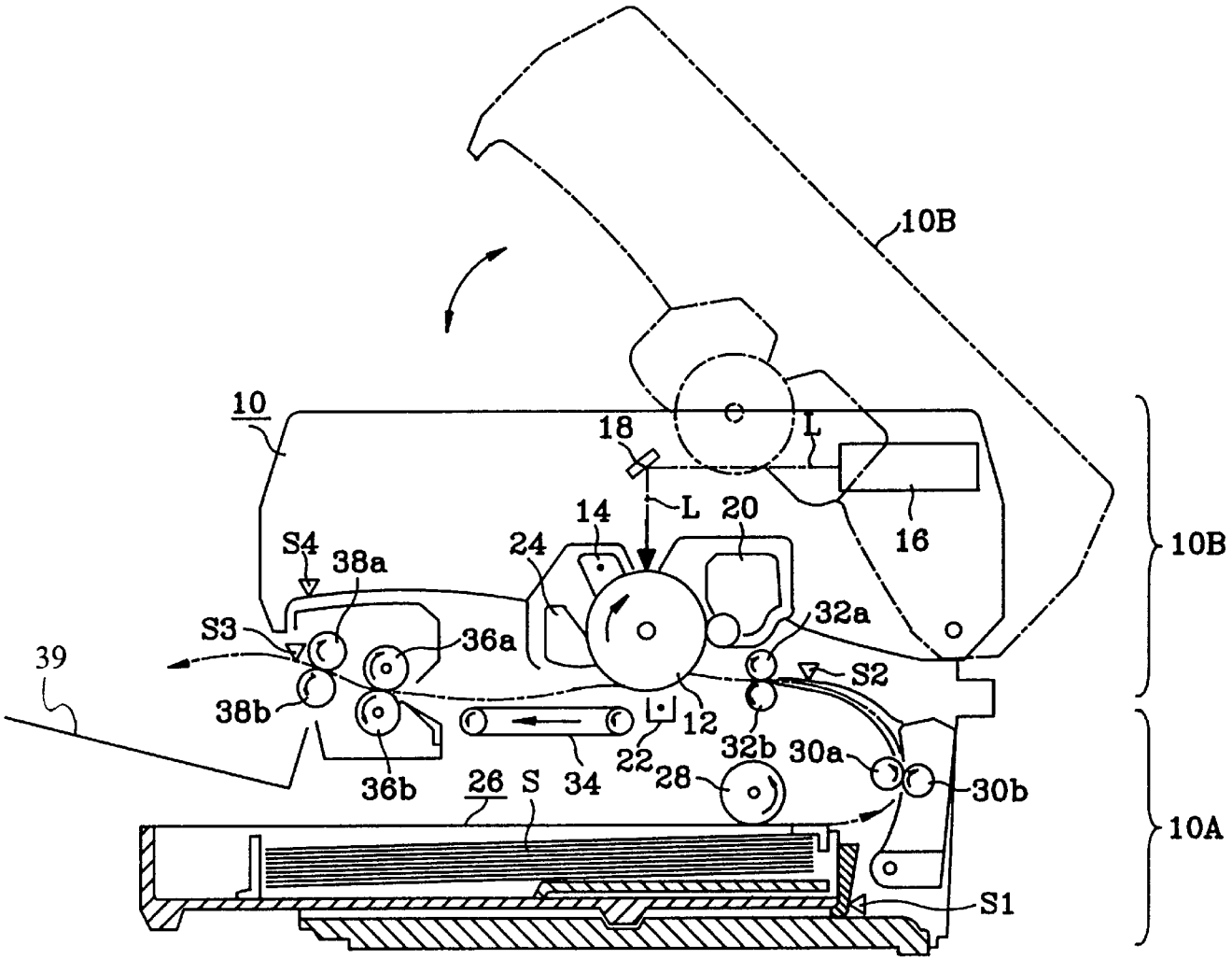
Fig. 1 CONVENTIONAL

IMAGE FORMING APPARATUS AND METHOD FOR CONTROLLING CHARGING POTENTIAL DIFFERENTLY BETWEEN IMAGE FORMING AREA AND NON-IMAGE FORMING AREA OF PHOTOSENSITIVE DRUM

CROSS-REFERENCE TO RELATED APPLICATION

This application makes reference to, incorporates the same herein, and claims all benefits accruing under 35 U.S.C. §119 from an application for *System And Method For Controlling Potential Of Photosensitive Drum* earlier filed in the Korean Industrial Property Office on 17 Sep., 1995 and there duly assigned Ser. No. 30745/1995.

BACKGROUND OF THE INVENTION

1. Technical Field

The present invention relates to an image forming apparatus using an electrophotographic process such as a laser beam printer, a copier and facsimile machine, and more particularly, relates to an image forming device in which a voltage potential applied to a charged photosensitive drum is efficiently controlled to minimize waste toner during printing operation.

2. Background Art

In an image forming apparatus such as a copier, a printer and a facsimile machine etc., using an electrophotographic process as generally disclosed, for example, in U.S. Pat. No. 5,002,266 for *Sheet Feed Apparatus For Image Forming Apparatus* issued to Kikuchi et al., a photosensitive drum is uniformly charged to a predetermined potential, and the charged portion of the photosensitive drum is exposed to a light image of an original document being reproduced. This creates an electrostatic latent image corresponding to the document image on the photosensitive drum. After the electrostatic latent image is formed on the photosensitive drum, the latent image is developed by applying toner particles from a developing unit into contact with the latent image formed on the photosensitive drum. This forms a toner image of the original document on the photosensitive drum which is subsequently transferred and fixed on a recording medium. When a toner image is fixed on a recording medium, the toner image is first heated and fused onto the recording medium, and then naturally cooled so that it is fixed onto the recording medium.

Generally, as a unit for charging the surface of the photosensitive drum, a charging roller using a so-called contact (or direct) charging scheme or a corona wire using a corona discharging scheme may be used to produce an uniform electric field in response to application of high voltage for charging the surface of the photosensitive drum to a constant potential to attract toner particles and thereby form the latent image on the photosensitive drum. Typically, the charging unit is negatively charged at the start of a printing operation. The surface of the photosensitive drum is negatively charged to about −600 V, and a developing unit is concurrently charged to −450 V as the photosensitive drum rotates in a direction opposite to the rotation of the developing unit. As a result, an electrostatic latent image is formed on the photosensitive drum and the latent image is then visualized as a toner image by the developing unit. The charged area of the photosensitive drum exposed to a laser beam, i.e. the area where the electrostatic latent image is formed through a laser scanner unit becomes −50 V. Because of the potential difference between the exposed area and the unexposed area of the photosensitive drum, the toner particles are attracted only to the exposed area to form the toner image on the photosensitive drum. The toner image is then transferred to the recording medium. After the toner image is transferred to the recording medium, the photosensitive drum is charged back to −600 V as the recording medium is being conveyed to a fixing unit. When the toner image is fixed on the recording medium by the fixing unit, the photosensitive drum is charged to a reference voltage. The residual toner on the surface of the photosensitive drum is then collected as waste toner.

During the non-image forming intervals in which the photosensitive drum and the developing unit are respectively charged to −600 V and −450 V, however, it has been my observation that the amount of waste toner increases, and the rate of toner actually used for each printing operation per unit amount of toner proportionally decreases. As a result, waste toner must be frequently replaced and a large container for containing waste toner must be undesirably required. Such a requirement adversely affects the production of compact and portable image forming apparatus. This is particularly true when an image forming apparatus is a non-cleaning system using a so-called contact charging scheme in lieu of a corona discharging scheme in which the charging roller is more readily contaminated with residue toner particles.

Conventionally, there are a number of known techniques for controlling the surface potential of a photosensitive drum to form an electrostatic latent image thereon as described, for example, in U.S. Pat. No. 5,072,258 for *Method Of Controlling Surface Potential Of Photoconductive Element* issued to Harada, U.S. Pat. No. 5,287,149 for *Image Forming Apparatus Having Image Transfer Electrode Contactable To Transfer Material* issued to Hoshika, and U.S. Pat. No. 5,534,982 for Developing Apparatus issued to Sakaizawa et al. For example, in Harada '258 and Sakaizawa '982, the surface potential of a photosensitive drum is charged depending upon its image area and its background. Similarly, Hoshida '149 discloses a charging technique in which the surface of the photosensitive drum is charged differently depending upon an image density. While these conventional charging techniques contain their own merits, it is my observation that none can efficiently minimize waste toner and thereby maximize the toner required to develop a toner image on the photosensitive drum.

SUMMARY OF THE INVENTION

Accordingly, it is therefore an object of the present invention to provide an improved image forming apparatus and process.

It is another object to provide a method for controlling potential of a charged photosensitive drum in an image forming apparatus to efficiently minimize waste toner and thereby maximize the toner required to develop a toner image on the photosensitive drum.

It is also an objective to provide a potential control device and a method for controlling potential of a charged photosensitive drum in a compact and portable image forming apparatus with minimum waste toner.

These and other objects of the present invention can be obtained by an improved image forming apparatus having a photosensitive drum; a charging unit for applying voltages differentially to the surface of the photosensitive drum during an image forming area where the photosensitive drum is in contact with a recording medium and during a non-image forming area where the photosensitive drum is not in contact with the recording medium to charge the surface of the photosensitive drum to a given polarity; a light scanner unit for forming an electrostatic latent image on the photosensitive drum corresponding to image data; a developing unit for applying toner onto the photosensitive drum during the image area to form a toner image; a transfer unit for transferring the toner image formed on the photosensitive drum to the recording medium; and a potential control unit for controlling the surface potential of the photosensitive drum by applying a first charging potential to the surface of the photosensitive drum during the image forming area when a laser beam from the laser scanner unit is incident on the image forming area so that a potential difference between the photosensitive drum and the developing unit is higher than a minimum voltage for development, and applying a second charging potential to the surface of the photosensitive drum during the non-image forming area when a laser beam from the laser scanner unit is incident on the image forming area so that a potential difference between the photosensitive drum and the developing unit is lower than the minimum voltage for development.

The present invention is more specifically described in the following paragraphs by reference to the drawings attached only by way of example.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein:

FIG. 1 is an abstract representation illustrating a conventional image forming apparatus using an electrophotographic developing process;

DETAILED DESCRIPTION OF THE PREFERRED EMBODIMENT

Figure 2:
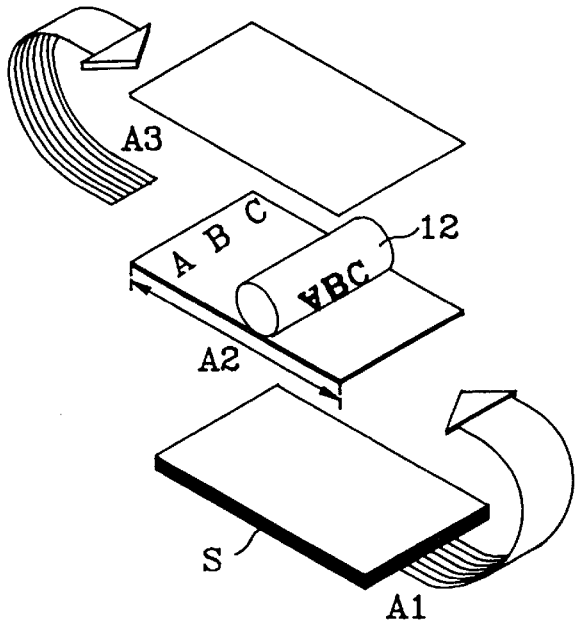
FIG. 2 is a sectional view illustrating the contact relation between a photosensitive drum and a recording medium.

Referring now to the drawings and particularly to FIG. 1, which is an abstract representation of a conventional image forming apparatus such as a laser beam printer using an electrophotographic developing process. The printer includes a housing 10 having a main body 10A and a cover 10B pivoted about a rear end hinge of the main body 10A in an upward direction when the cover 10B is in an open position and in a downward direction when the cover 10B is in a closed position. The printer also includes an optical assembly using a laser scanner unit 16, a reflecting mirror 18 and an imaging lens (not shown); an imaging assembly constructed with a charging device 14, a developing unit 20, a photosensitive drum 12, a cleaning device 24 and a transfer device 22; a paper transport assembly having a cassette 26 for containing a recording medium such as a stack of cut sheet paper S, a sheet feed roller 28, a pair of convey rollers 30*a*, 30*b* and a pair of registration rollers 32*a*, 32*b* from an upstream side along a direction of transport of a sheet S of the recording paper. The paper transport assembly also includes a transport belt 34, a pair of fixing rollers 36*a*, 36*b*, a pair of discharge rollers 38*a*, 38*b* and a discharge tray 39 and the like so as to transport the recording paper separated from the photosensitive drum 12.

Typically, the photosensitive drum 12 is uniformly charged by the charging device 14 to a predetermined potential. The laser scanner unit 16 generates a laser beam L corresponding to image data, and then scans a surface of the photosensitive drum 12. The uniformly charged surface of the photosensitive drum 12 is scanned with the laser beam L through the reflecting mirror 18 in a manner that an electrostatic latent image corresponding to image data is formed on the photosensitive drum 12.

The developing unit 20 provides a developer to the latent image formed on the photosensitive drum 12 to visualize the same as a toner image. The sheet feed roller 28 picks up the uppermost sheet S of paper stacked on the cassette 26 and feeds the sheet of paper into the image forming apparatus. The pair of convey rollers 30*a* and 30*b* then convey the sheet of paper picked up by the sheet feed roller 28 to registration rollers 32*a* and 32*b*. The sheet of paper is guided by registration rollers 32*a* and 32*b* conveyed by the sheet feed roller 28 and sheet convey rollers 30*a* and 30*b*. The transfer charger 22 transfers the toner image formed on the photosensitive drum 12 to the sheet of paper. The cleaning device 24 cleans the residual toner and electrostatic image on the surface of the photosensitive drum 12 after the toner image is transferred on the sheet of paper. The sheet of paper is then conveyed to sheet fixing rollers 36*a*, 36*b* by a sheet transport belt 34. The fixing rollers 36*a* and 36*b* fix the transferred toner image on the sheet of paper. The sheet of paper is then delivered as an image formed product on discharge tray 39 through sheet discharge rollers 38*a* and 38*b*.

In general, the laser beam printer as shown in FIG. 1 also includes a plurality of sensors to sense the operating condition of each component of the printer or a sheet-conveyance condition. A first sensor S1 disposed at a leading end of the cassette 26 mounted inside the main body 10A for sensing the mounting condition of the paper cassette 26. A second sensor S2 is mounted on a sheet-conveyance path between the sheet convey rollers and the registration rollers 32*a* and 32*b* for sensing a sheet conveyance condition from the cassette 26 to the registration rollers 32*a* and 32*b*. A third sensor S3 is disposed on a sheet discharge path at the rear end of the sheet discharge rollers 38*a* and 38*b* for detecting a sheet discharging condition from the sheet discharge rollers 38*a* and 38*b*. A fourth sensor S4 is disposed on one side of the cover 10B opposite to that of the main body 10A, for sensing whether the cover 10B is in a closed position.

Typically, the charging device 14 is turned on in response to the start of a printing operation to charge the surface of the photosensitive drum 12 and to maintain a constant potential of a charged photosensitive drum 12. The conventional image forming apparatus as shown in FIG. 1 has a problem in that the photosensitive drum 12 and the developing units developing sleeve rotate even before a leading edge of each sheet of paper fed by the sheet feed roller 28 is in contact with the surface of the photosensitive drum 12, and even after a printing operation is completed when the rear end of the sheet of paper passes through the photosensitive drum 12.

Figure 3:
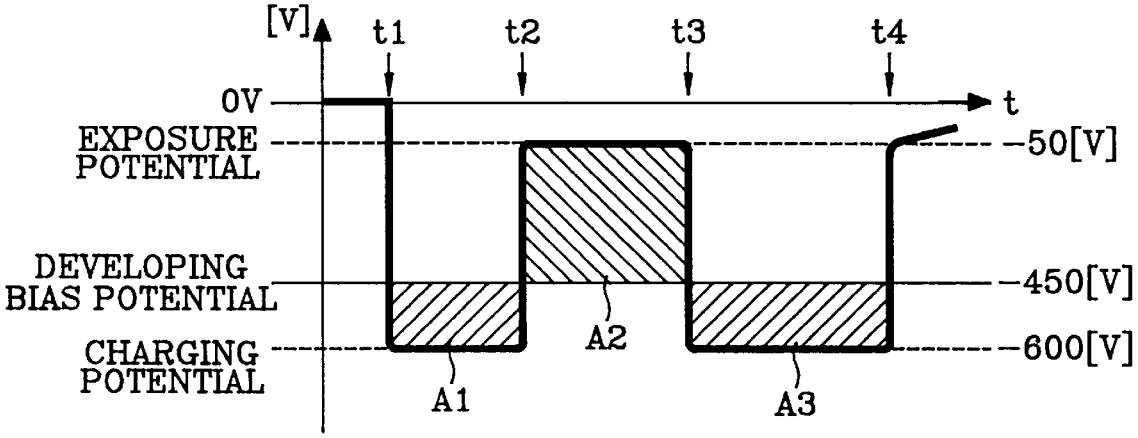
FIG. 3 illustrates a voltage characteristic including an exposure potential, a developing bias potential and a charging potential of a conventional image forming apparatus.

FIGS. 2 and 3 now illustrate the contact relation between the photosensitive drum 12 and each sheet S of paper, and voltage characteristics with respect to the exposure potential, developing potential and charging potential, respectively.

Referring to FIG. 2, as a sheet S of paper contained in the paper cassette 26 is picked up and conveyed to area A2 where the sheet S of paper is in contact with the surface of the photosensitive drum 12 through area A1 upon start of a printing operation, the toner image is transferred to the sheet S of paper. After the toner image is transferred to the sheet S of paper, the sheet S of paper is then conveyed to the fixing rollers 36*a*, 36*b* where the toner image is fixed at area A3, and subsequently delivered through the sheet discharge rollers 38*a*, 38*b*. The area A2 where the laser scanning begins and the sheet S of paper comes in contact with the photosensitive drum 12 is now referred to as an image area. The areas A1 and A3 where the laser scanning is not performed and the sheet S of paper does not contact the photosensitive drum 12 is known as a non-image area.

FIG. 3 illustrates a voltage characteristic according to the exposure potential, developing potential and charging potential of the conventional image forming apparatus. As the charging device 14 is negatively charged at time t1 in which a printing operation begins, the surface of the photosensitive drum 12 is also negatively charged to about −600 V. At this point, the developing unit 20 is negatively charged with −450 V, and as a main motor (not shown) drives at the point when the sheet S of paper is picked up, the photosensitive drum 12 rotates in a direction opposite to the rotation of the developing unit.

An electrostatic latent image is formed on the photosensitive drum 12 according to the rotation of the developing unit 20. The formed latent image is visualized as a toner image by the developing unit. The area of the photosensitive drum 12 exposed to the laser beam, i.e. the area where the electrostatic latent image is formed through the laser scanner unit 16 becomes charged to −50 V to attract the toner particles from the developing unit 20 to form a toner image. The toner image is then transferred to the sheet S of paper by the transfer device 22. As the laser scanning at the rear end of the sheet S of paper is completed at time t3, the photosensitive drum 12 becomes charged to −600 V by the charging device 14. As the operation of the charging device 14 is completed at time t4 when the sheet S of paper is delivered, the photosensitive drum 12 is charged to a reference voltage. The electrostatic latent image formed on the photosensitive drum 12 that passed through the transfer device 22 at time t1 to t4 is removed by the cleaning device 24, and a residual toner on the surface of the photosensitive drum 12 is collected as waste toner.

During the non-image area A1 between time t1 and t2 and the non-image area A3 between time t3 and t4 in which the photosensitive drum 12 and the developing unit 20 are respectively charged to −600 V and −450 V, as described above, the amount of waste toner increases and the rate of toner actually used for each printing operation per unit amount of toner proportionally decreases. As a result, waste toner must be frequently replaced and large container for containing waste toner must be undesirably required. Such a requirement adversely affects the production of compact and portable image forming apparatus. This is particularly true when an image forming apparatus is a non-cleaning system using a so-called contact charging scheme in lieu of a corona discharging scheme in which the charging roller is more readily contaminated with residue toner particles particularly in the non-image areas A1 and A3.

Figure 4:
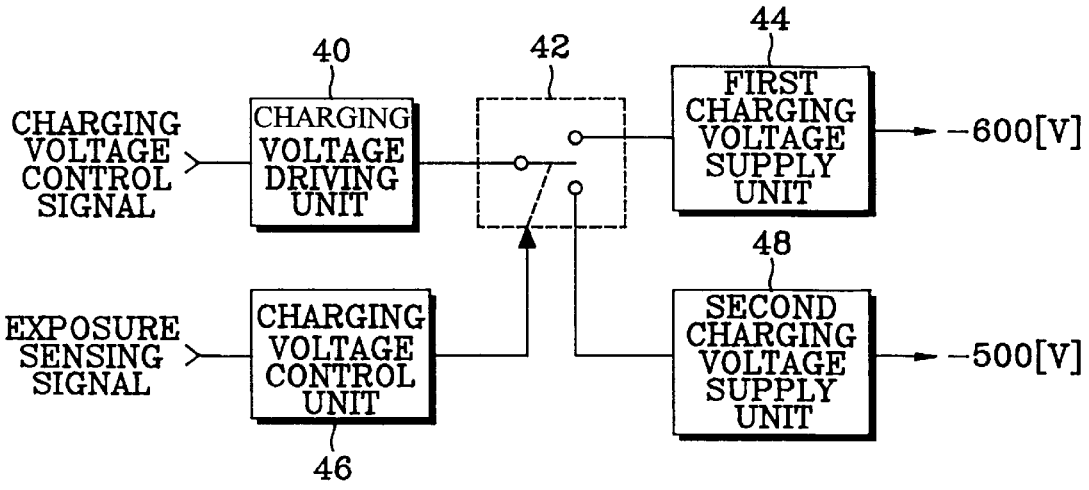
FIG. 4 is a block diagram illustrating a potential control device for controlling a potential of a charged photosensitive drum usable in an image forming apparatus according to the principles of the present invention.

Turning now to FIG. 4 which illustrates a potential control device for controlling a potential of a charged photosensitive drum according to the principles of the present invention. As shown in FIG. 4, the potential control device includes a charging voltage driving unit 40 for producing a driving signal in response to a charging voltage control signal, a charging voltage control unit 46 for producing a first voltage selection signal for selecting a first charging voltage supply unit 44 on exposure to a laser beam and for producing a second voltage selection signal for selecting a second charging voltage supply unit 48 on non-exposure to a laser beam, in response to an exposure sensing signal informing the operation of a laser scanner unit 16. The first charging voltage supply unit 44 supplies a voltage of −600 V to a charging device 14 in response to reception of the driving signal produced from the charging voltage driving unit 40. The second charging voltage supply unit 48 supplies a voltage of −500 V to the charging device 14 in response to reception of the driving signal produced from the charging voltage driving unit 40.

The potential control device also includes a driving selection unit 42 for transmitting the driving signal from the charging voltage driving unit 40 to the first charging voltage supply unit 44 when the selection signal produced from the charging voltage control unit 46 represents a first voltage selection signal, and for transmitting the driving signal from the charging voltage driving unit 40 to the second charging voltage supply unit 48 when the selection signal produced from the charging voltage control unit 46 represents a second voltage selection signal. Thus, in the potential-controlling device, the charging device 14 is supplied with a voltage of −500 V to −600 V in response to the exposure sensing signal when there is a command to apply voltage.

Figure 5:
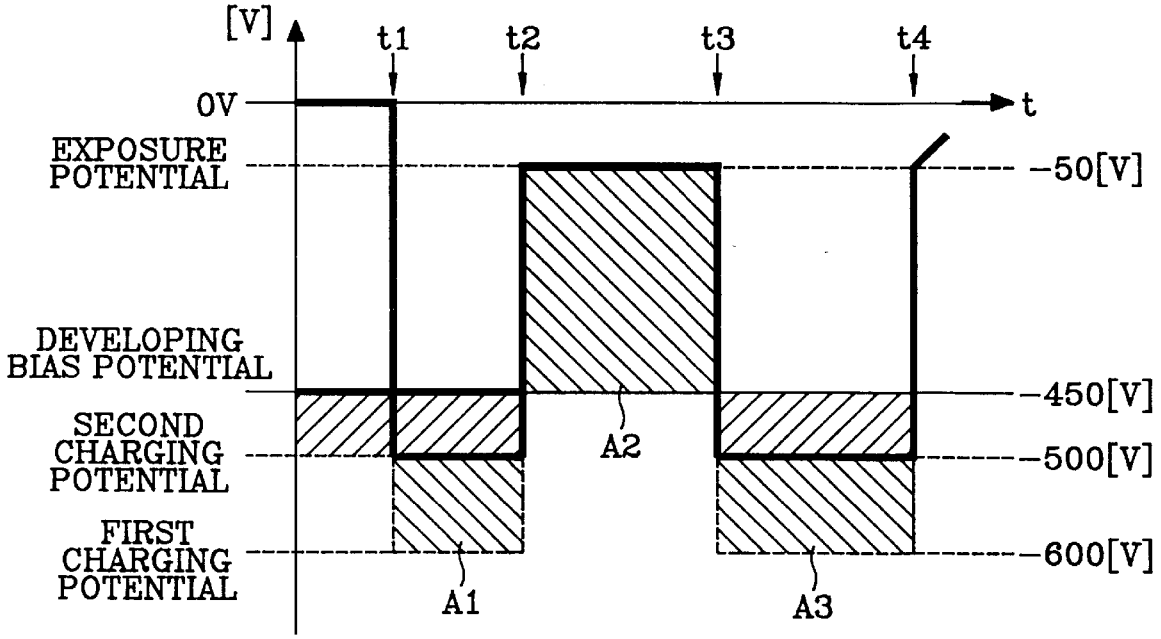
FIG. 5 illustrates a voltage characteristic including an exposure potential, a developing bias potential, a first charging potential and a second charging potential of an image forming apparatus as incorporated therein a potential control device for controlling a potential of a charged photosensitive drum constructed according to the principles of the present invention.

FIG. 5 illustrates a voltage characteristic including an exposure potential, a developing bias potential, a first charging potential and a second charging potential of an image forming apparatus as incorporated therein a potential control device for controlling a potential of a charged photosensitive drum constructed according to the principles of the present invention.

The printing operation of the image forming apparatus as incorporated therein a potential control device constructed according to the principles of the present invention will now be described with reference to FIGS. 1, 4 and 5 as follows.

The printing operation starts at time t1 as shown in FIG. 5, prior to the laser scanning. The charging voltage control unit 46 switches on the second charging voltage supply unit 48 as shown in FIG. 4 to transmit the driving signal produced from the charging voltage driving unit 40 to the second charging voltage supply unit 48. Accordingly, a negative potential of −450 V is applied to the charging device 14, and the surface of the photosensitive drum 12 becomes negatively charged to −500 V. As a result, the potential difference between the photosensitive drum 12 and the developing unit 20 becomes 50 V, which is 100 V lower than that required in the conventional image forming apparatus so as to significantly reduce the amount of toner to be negatively charged. Sequentially, the uniformly charged surface of the photosensitive drum 12 is scanned with the laser beam from the laser scanner unit 16 at time t2 to t3 to form an electrostatic latent image corresponding to output image data on the photosensitive drum 12.

Referring back to FIG. 4, as the laser scanning starts, the charging voltage control unit 46 switches on the driving selection unit 42 to transmit the driving signal from the charging voltage driving unit 40 to the first charging voltage supply unit 44. Accordingly, a negative potential of −600 V is applied to the charging device 14. As a result, the potential difference between the photosensitive drum 12 and the developing unit 20 is kept to be 150 V enough for development. The toner applied to the image area A2 where the photosensitive drum 12 and the developing unit 20 comes into contact with each other is rubbed therewith to be negatively charged. The voltage of the image forming area on the photosensitive drum 12 that passes through the laser scanner unit 16 becomes −50 V. Through the developing unit 20, just the laser-scanned area of the photosensitive drum 12 attracts and holds the toner according to the potential difference between the scanned area and the developing unit 20 charged to −50 V and −450 V, respectively. As laser scanning on the rear end of the sheet S of paper is completed at time t3, the voltage controlling unit 46 switches on the driving selection unit 42 to transmit the driving signal produced from the charging voltage driving unit 40 to the second charging voltage supply unit 48. Accordingly, a negative voltage of −500 V is again applied to the charging device 14. As the potential difference between the photosensitive drum 12 and the developing unit 20 is kept to be 50 V, the toner negatively charged and adhered to the photosensitive drum 12 may be significantly decreased.

The printing operation is completed and the sheet S of paper is delivered to the discharge tray 39 at time t4 so that the operation of the charging device 14 is completed and the photosensitive drum 12 is charged to a reference voltage. The electrostatic latent image formed on the photosensitive drum 12 that has passed through the transfer device 22 at time t1 to t4, is removed by the cleaning device 24, and the residual toner on the surface of the photosensitive drum 12 is collected as waste toner. At time t1 to t2 and t3 to t4, i.e. in the non-image areas A1 and A3, the potential difference between the photosensitive drum 12 and the developing unit 20 is decreased, and the amount of the negatively charged toner is significantly reduced, which minimizes the amount of waste toner.

As described above, the present invention controls a voltage applied to charge the surface of a photosensitive drum in response to laser scanning. That is, in case of exposure to a laser beam, a potential is applied to the surface of the photosensitive drum so that the potential difference between the photosensitive drum and the developing unit becomes quite low so as to significantly reduce the amount of negatively charged toner, whereas a potential enough for development is applied to the drum to make the latent image visible. Reduction in the amount of negatively charged toner that is released as waste toner, may enhance the toner-using efficiency. When it comes to a laser beam printer employing a non-cleaning system, the inventive system can prevent a charging roller from being contaminated by negatively-charged toner and enables the manufacture of thin, light and small products.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. An image forming apparatus, comprising:

a photosensitive drum;

a charging unit for charging a surface of said photosensitive drum by applying voltages differentially to an image forming area of said photosensitive drum where said photosensitive drum is in contact with a recording medium, and a non-image forming area of said photosensitive drum where said photosensitive drum is not in contact with said recording medium;

a light scanner unit for scanning a laser beam corresponding to image data onto said image forming area of said photosensitive drum to form an electrostatic latent image on said photosensitive drum;

a developing unit for applying toner onto said image forming area of said photosensitive drum to form a toner image on said photosensitive drum;

a transfer unit for transferring the toner image formed on said photosensitive drum to said recording medium; and a potential control unit for controlling the surface potential of said photosensitive drum by applying a first charging potential to said image forming area of said photosensitive drum when the laser beam from said light scanner unit is incident upon said image forming area so that a potential difference between said photosensitive drum and said developing unit is higher than a minimum voltage for image development, and applying a second charging potential to said non-image forming area of said photosensitive drum when the laser beam light scanner unit is incident upon said image forming area so that a potential difference between said photosensitive drum and said developing unit is lower than the minimum voltage for image development.

2. The image forming apparatus of claim 1, further comprised of said first charging potential having an absolute value greater than said second charging potential.

3. The image forming apparatus of claim 1, further comprised of said first charging potential corresponding to −600 volts, and said second charging potential corresponding to −500 volts.

4. An image forming apparatus, comprising:

a photosensitive drum;

a charging unit;

a light scanner unit for forming an electrostatic latent image on said photosensitive drum corresponding to image data;

a developing unit for applying toner onto said photosensitive drum while said photosensitive drum is in contact with a recording medium during an image forming area;

a transfer unit for transferring a toner image formed on said photosensitive drum to said recording medium; and a potential control unit responsive to a start of a print operation, for applying a first charging potential to said photosensitive drum during said image forming area to charge said photosensitive drum to a given voltage for development, and for applying a second charging potential to said photosensitive drum during a non-image area when said photosensitive drum is not in contact with said recording medium.

5. The image forming apparatus of claim 4, further comprised of said first charging potential having an absolute value greater than said second charging potential.

6. The image forming apparatus of claim 4, further comprised of said first charging potential corresponding to −600 volts, and said second charging potential corresponding to −500 volts.

7. A method for controlling a surface potential of a photosensitive drum and a developing unit for forming an image in an image forming apparatus, said method comprising the steps of:

applying a first charging potential to the surface of said photosensitive drum during an image forming area when said photosensitive drum is in contact with a recording medium so that a potential difference between said photosensitive drum and said developing unit is higher than a minimum voltage for development; and applying a second charging potential to the surface of said photosensitive drum during a non-image forming area when said photosensitive drum is not in contact with said recording medium so that a potential difference between said photosensitive drum and said developing unit is lower than the minimum voltage for development.

8. The method of claim 7, further comprised of said first charging potential having an absolute value greater than said second charging potential.

9. The method of claim 7, further comprised of said first charging potential corresponding to −600 volts, and said second charging potential corresponding to −500 volts.

10. An image forming apparatus, comprising:

an image carrier;

a charging unit for charging a surface of the image carrier;

a developing unit for applying toner onto said image carrier to develop a toner image on said image carrier;

a transfer unit for transferring a toner image formed on said image carrier to a recording medium; and control means responsive to a start of a print operation, for controlling said charging unit to charge the surface of an image forming area of said image carrier with a first charging voltage when said image carrier is in contact with said recording medium so that a potential difference between said image carrier and said developing unit is higher than a minimum voltage for image development, and for controlling said charging unit to charge the surface of a non-image forming area of said image carrier with a second charging voltage when said image carrier is not in contact with said recording medium so that a potential difference between said image carrier and said developing unit is lower than the minimum voltage for image development.

11. The image forming apparatus of claim 10, further comprised of said first charging voltage exhibiting an absolute value greater than that of said second charging voltage.

12. The image forming apparatus of claim 10, further comprised of said first charging voltage corresponding to −600 volts, and said second charging voltage corresponding to −500 volts.

13. The image forming apparatus of claim 10, further comprised of said control means comprising:

a first charging voltage supply unit for supplying said first charging voltage to said charging unit;

a second charging voltage supply unit for supplying said second charging voltage to said charging unit;

a charging voltage control unit for enabling transmission of said first charging voltage to said charging unit to charge the surface of said image forming area of said image carrier when said image carrier is in contact with said recording medium, and for enabling transmission of said second charging voltage to said charging unit to charge the surface of said non-image forming area of said image carrier when said image carrier is not in contact with said recording medium.

14. The image forming apparatus of claim 13, further comprised of said first charging voltage exhibiting an absolute value greater than that of said second charging voltage.

15. The image forming apparatus of claim 13, further comprised of said first charging voltage corresponding to −600 volts, and said second charging voltage corresponding to −500 volts.

* * * * *